US009809038B2

(12) United States Patent
Ishihara et al.

(10) Patent No.: US 9,809,038 B2
(45) Date of Patent: Nov. 7, 2017

(54) DROPLET DRYING DEVICE AND IMAGE FORMING APPARATUS

(71) Applicant: FUJI XEROX CO., LTD., Tokyo (JP)

(72) Inventors: Takuma Ishihara, Kanagawa (JP); Takeshi Zengo, Kanagawa (JP); Takehiro Niitsu, Kanagawa (JP); Akira Sakamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/237,772

(22) Filed: Aug. 16, 2016

(65) Prior Publication Data

US 2017/0217210 A1 Aug. 3, 2017

(30) Foreign Application Priority Data

Feb. 3, 2016 (JP) ..... 2016-019180

(51) Int. Cl.
*B41J 11/00* (2006.01)
*B41J 2/01* (2006.01)

(52) U.S. Cl.
CPC ..... *B41J 11/002* (2013.01); *B41J 2/01* (2013.01)

(58) Field of Classification Search
CPC ..... B41J 11/002; B41J 2/01
See application file for complete search history.

(56) References Cited

U.S. PATENT DOCUMENTS

2013/0235135 A1* 9/2013 Kondo ..... B41J 11/002 347/102

FOREIGN PATENT DOCUMENTS

JP 2014-083762 5/2014
JP 2014-083762 * 12/2014 ..... B41J 2/01

OTHER PUBLICATIONS

Abstract and machine translation of JP 2014-083762.

* cited by examiner

*Primary Examiner* — Henok Legesse
(74) *Attorney, Agent, or Firm* — Fildes & Outland, P.C.

(57) ABSTRACT

A droplet drying device includes a plurality of light emitting devices arranged in a two-dimensional manner to irradiate droplets with light to dry the droplets, the droplets being ejected on a recording medium by an ejection unit, a regular irradiation capability portion provided in a region corresponding to an image forming region of the recording medium where an image is formed, the regular irradiation capability portion having a predetermined light irradiation capability, and a low irradiation capability portion provided in a region corresponding to a region of the recording medium set to have a lower image-forming density than the image forming region, a light irradiation capability of the low irradiation capability portion being lower than the predetermined light irradiation capability.

13 Claims, 7 Drawing Sheets

DROPLET DRYING DEVICE AND IMAGE FORMING APPARATUS

CROSS-REFERENCE TO RELATED APPLICATIONS

This application is based on and claims priority under 35 U.S.C. 119 from Japanese Patent Application No. 2016-019180 filed Feb. 3, 2016.

TECHNICAL FIELD

The present invention relates to a droplet drying device and an image forming apparatus.

SUMMARY

According to an aspect of the invention, a droplet drying device is provided. The droplet drying device includes a plurality of light emitting devices arranged in a two-dimensional manner to irradiate droplets with light to dry the droplets, the droplets being ejected on a recording medium by an ejection unit, a regular irradiation capability portion provided in a region corresponding to an image forming region of the recording medium where an image is formed, the regular irradiation capability portion having a predetermined light irradiation capability, and a low irradiation capability portion provided in a region corresponding to a region of the recording medium set to have a lower image-forming density than the image forming region, a light irradiation capability of the low irradiation capability portion being lower than the predetermined light irradiation capability.

According to another aspect of the invention, an image forming apparatus is provided. The image forming apparatus includes an ejection unit that ejects droplets on a recording medium to form an image on the recording medium, and the droplet drying device disposed downstream of the ejection unit in a conveying direction which the recording medium is conveyed.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be described in detail with reference to the drawings. Note that an example, in which an image forming apparatus according to an exemplary embodiment of the invention is applied to an inkjet type image forming apparatus, exemplifies the exemplary embodiment.

First, a configuration of an image forming apparatus 10 and a droplet drying device 14 according to an exemplary embodiment is described with reference to FIGS. 1A and 1B.

Figure 1A:
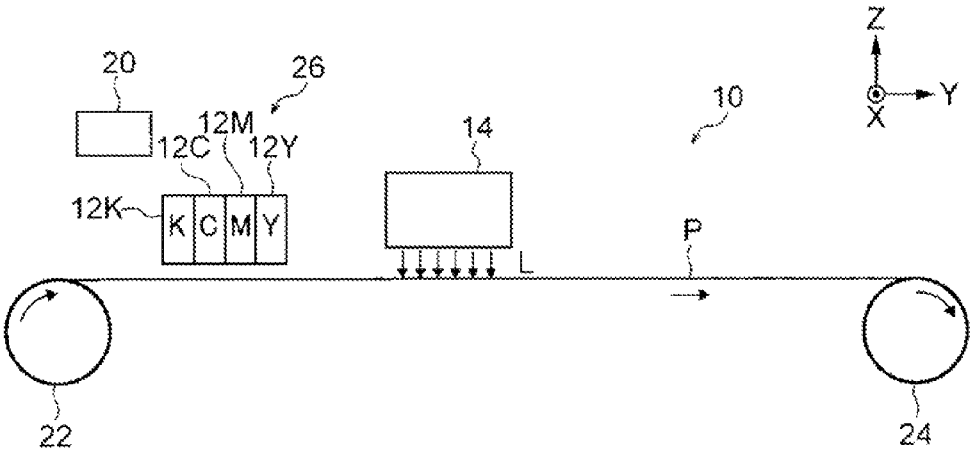
FIG. 1A is a diagram illustrating an example of a configuration of an image forming apparatus according to an exemplary embodiment of the present invention.
Figure 1B:
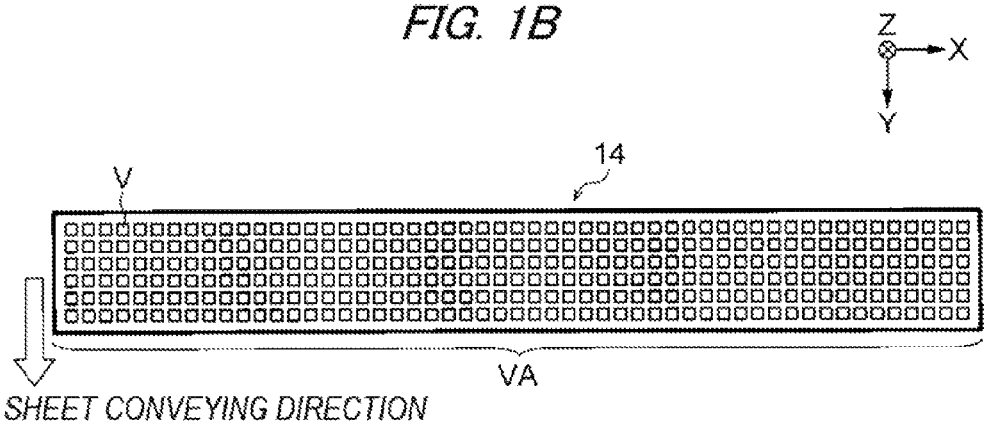
FIG. 1B is a diagram illustrating an example of a configuration of a droplet drying device of the image forming apparatus.

As shown in FIG. 1A, the image forming apparatus 10 includes a head unit 26, a droplet drying device 14, a controller 20, a feeding roll 22, and a winding roll 24. The image forming apparatus 10 has a function of forming an image on a front surface of continuous paper (paper roll) P as a recording medium, in addition to an image on a rear surface thereof, as necessary.

The head unit 26 includes an inkjet head 12K that forms a black (K) image, an inkjet head 12C that forms a cyan (C) image, an inkjet head 12M that forms a magenta (M) image, and an inkjet head 12Y that forms a yellow (Y) image, each head being configured to eject ink droplets (example of droplets) to the continuous paper P. The inkjet bead 12K, the inkjet bead 12C, the inkjet head 12M, and the inkjet head 12Y are disposed to face the continuous paper P in this order from an upstream side to a downstream side of the continuous paper P a conveying direction (Y direction indicated by an arrow below the reference sign P in FIG. 1A, hereinafter, referred to as a "sheet conveying direction"). Note that, in the exemplary embodiment, the arrangement order of the inkjet head 12K, the inkjet bead 12C, the inkjet head 12M, and the inkjet head 12Y is described as an example and is not limited to the order in FIG. 1A.

The droplet drying device 14 is disposed on the downstream side of the head unit 26 in the sheet conveying direction and dries an image formed on the continuous paper P. The droplet drying device 14 according to the exemplary embodiment includes a plurality of light emitting devices as heat sources for drying the image formed on the continuous paper P and performs irradiation with irradiation light L. For example, a semiconductor laser or a light emitting diode (LED) is used as the light emitting device as the heat source.

A type of semiconductor laser is not limited to an edge-emitting type, a surface emitting type, or the like, and, in the exemplary embodiment, a vertical cavity surface emitting laser (VCSEL) element is used.

The feeding roll 22 is a portion that supplies the continuous paper P to the head unit 26 and the continuous paper P is wound around the roll. The feeding roll 22 is rotatably supported by a frame member (not shown).

The winding roll 24 is a portion at which the image-formed continuous paper P is wound around the roll. The winding roll 24 receives a rotational force from a motor (not shown) and rotates, and thereby the continuous paper P is conveyed in the sheet conveying direction.

The controller 20 controls the respective members of the image forming apparatus 10, collectively.

The image forming apparatus 10 configured as described above operates as follows. In other words, the winding roll 24 is rotated, then, tension in the sheet conveying direction is applied to the continuous paper P, and the continuous paper P supplied from the feeding roll 22 is conveyed in the sheet conveying direction. The ink droplets land on the front surface of the continuous paper P, which is conveyed in the sheet conveying direction, first, by the head unit 26, and an image is formed on the front surface. The image-formed continuous paper P is conveyed to the droplet drying device 14 and is dried.

Next, the droplet drying device 14 according to the exemplary embodiment will be described with reference to FIG. 1B. As shown in FIG. 1B, the droplet drying device 14 includes plural (53×6=318 illustrated in a case shown in FIG. 1B) light emitting devices V arranged to form an array pattern in the sheet conveying direction (referred to as a "sub-scanning direction" in some cases) and a direction (referred to as an X-axial direction, a "main scanning direction", or a "paper-width direction" in some cases) orthogonal to (intersection with) the sheet conveying direction. In the exemplary embodiment, all of the light emitting devices V arranged in the array pattern are referred to as a "light emitting device array VA". In a case where the image-formed continuous paper P is dried, light is emitted from each of the light emitting devices V.

Note that, in the exemplary embodiment, an example, in which the droplet drying device 14 includes 318 light emitting devices V, is described; however, the number of the light emitting devices V is not limited thereto, and the appropriate number may be selected depending on required drying capability or the like. In addition, in the exemplary embodiment, an example, in which the light emitting devices V are uniformly arranged to form an array pattern, is described; however, the arrangement is not limited thereto, and an arrangement pattern may be appropriately selected from, for example, a checkerboard pattern or a zigzag pattern, depending on a drying target or the like. Further, in the exemplary embodiment, an example, in which the light emitting devices V are arranged as they are, is described; however, the arrangement is not limited thereto, and a method, in which the plural light emitting devices V form one light emitting device block and plural light emitting device block are arranged, may be employed. In addition, the light emitting device V is not limited to a single light emitting device, but may be an array-type light emitting device in which plural light emitting devices are arranged to form an array pattern.

In general, light intensity of the light emitting device is controlled by controlling a drive current flowing to the light emitting device and, in the droplet drying device 14 according to the exemplary embodiment, light intensity is also controlled by controlling the drive current flowing to the light emitting device V. Therefore, a drive circuit (driver, not shown) that controls the drive current is connected to each of the light emitting devices V. In addition, in a case where the light emitting device block described above is used, the drive current may be controlled by unit of the light emitting device block.

As described above, the droplet drying device using the light emitting device has a configuration in which the multiple light emitting devices are commonly arranged to form the array pattern such that light output is uniform. In particular, a case of using a semiconductor laser element as the light emitting device, the semiconductor laser element is expensive, in general. Thus, as long as the droplet drying device having such a configuration is used, there is certain limitation to lowering costs.

Therefore, in the exemplary embodiment of the invention, during an operation of the droplet drying device having the configuration in which the light emitting devices are arranged in a two-dimensional manner, a light irradiation capability of a region which is normally required a low light output, that is, a region in which a density of an image formed on a recording medium is normally low is lower than a light irradiation capability of the other regions. Hereinafter, in the exemplary embodiment, a region having a normal light irradiation capability is referred to as a "regular irradiation capability portion", and a region having a light irradiation capability lower than the regular irradiation capability portion is referred to as a "low irradiation capability portion".

In the exemplary embodiment, for example, the low irradiation capability portion may be achieved by arranging the light emitting devices in a pattern in which the light emitting devices arranged in the regular irradiation capability portion are thinned out, arranging at least one light emitting device having low light output capability, or arranging no light emitting devices. When the light emitting devices are thinned out (the number of the light emitting devices is decreased), or no light emitting devices are arranged, the costs of the droplet drying device are lowered.

For example, the light emitting device having low light output capability is an light emitting device having low light output with respect to the same drive current, and, in general, the costs of the light emitting devices having low light output capability are often reduced to be low. Thus, the method also allows the costs of the low irradiation capability portion to be lowered. By using this method, the costs of the droplet drying device in the entirety are decreased. Hereinafter, this method will be described in detail.

Figure 2:
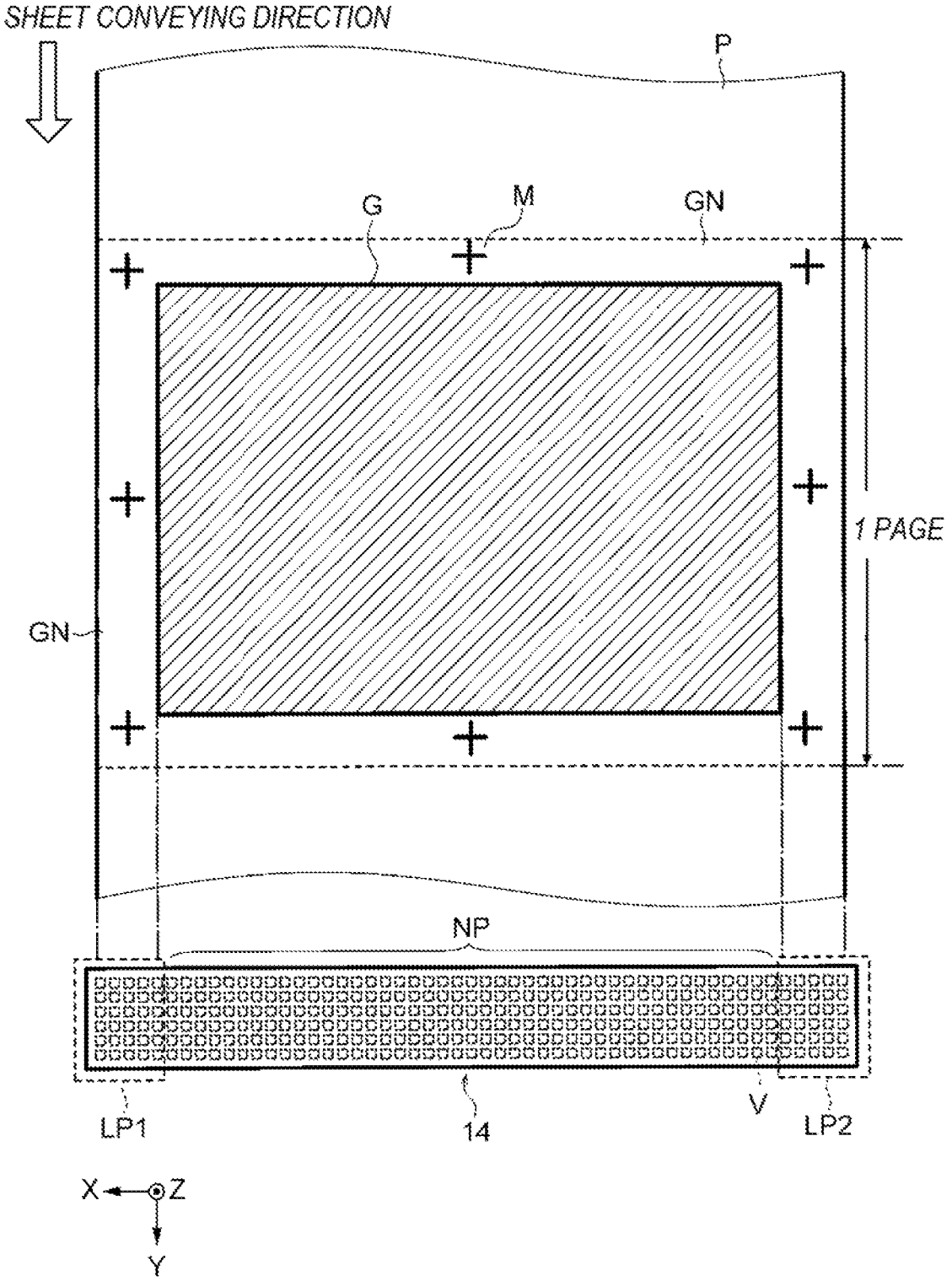
FIG. 2 is a diagram illustrating a location of a low irradiation capability portion of the droplet drying device.

First, a position of the low irradiation capability portion in the droplet drying device 14 according to the exemplary embodiment will be described with reference to FIG. 2. FIG. 2 is a plan view of the droplet drying device 14 of FIG. 1A seen from above together with the continuous paper P.

As shown in FIG. 2, a region of one page (hereinafter, "page region") is predetermined in the continuous paper P, and an image forming region G as a region, in which an actual image of an original document or the like is formed by the head unit 26, is set within the page region. A region (hereinafter, "no-image forming region GN") other than the image forming region G in the page region is a margin, and, even as an image that is formed in the region, a line of a mark M for registration matching, a page number, a date, or the like. In other words, since a picture or the like is rarely formed, image forming density is normally low in the no-image forming region GN. Hence, it is highly possible that the droplet drying device 14 does not need to have high drying capability with respect to the no-image forming region GN.

In the droplet drying device 14 according to the exemplary embodiment, in consideration of circumstances described above, a low irradiation capability, portion LP is provided to a region of the droplet drying device 14 corresponding to the no-image forming region GN. The low irradiation capability portion LP is a region in which the irradiation capability is reduced to be low in the light emitting device array VA by this method described above. In FIG. 2, since the no-image forming regions GN are present on both sides of the continuous paper P in the sheet conveying direction, two portions of a low irradiation capability portion LP1 and a low irradiation capability portion LP2 are provided as the low irradiation capability portion LP. A region of the light emitting device array VA other than the low irradiation capability portion LP is the regular irradiation capability portion NP described above.

Next, the low irradiation capability portion LP according to a first exemplary embodiment will be described with reference to FIGS. 3A and 3B.

Figure 3A:
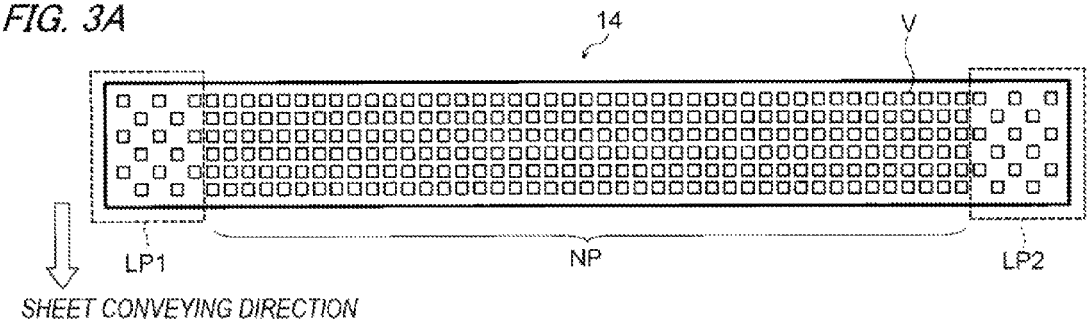
FIG. 3A is a diagram illustrating an arrangement of light emitting devices in a light emitting device array of a droplet drying device according to a first exemplary embodiment of the present invention.

As shown in FIG. 3A, in the low irradiation capability portions LP (LP1 and LP2) according to the exemplary embodiment, the light emitting devices V are not arranged in the closest manner and are arranged in a pattern in which the light emitting devices V arranged in the regular irradiation capability portion NP are thinned out, and thereby the density of the arrangement of the light emitting devices V is reduced to be low.

Figure 3B:
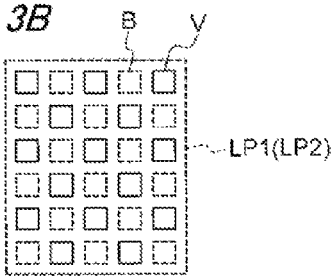
FIG. 3B is a diagram illustrating an arrangement of light emitting devices in a low irradiation capability portion of the droplet drying device according to the first exemplary embodiment.

FIG. 3B shows the low irradiation capability portion LP in detail. As shown in FIG. 3B, in the exemplary embodiment, a non-mounting portion B, in which the light emitting device V is not disposed, is provided such that the light emitting devices V is arranged to form the checkerboard pattern. In the exemplary embodiment, the arrangement of the light emitting devices V in the checkerboard pattern results in uniform arrangement of the light emitting devices V in a direction (X-axial direction shown in FIGS. 1A and 1B) perpendicular to the sheet conveying direction, and in the sheet conveying direction (Y-axial direction shown in FIGS. 1A and 1B) such that drying unevenness is reduced.

In the droplet drying device according to the exemplary embodiment, since the number of the light emitting devices V that are relatively high in costs is reduced, reduction of the costs is achieved.

Note that, in the exemplary embodiment, the example of the pattern in which the light emitting devices V are thinned out by being arranged in the checkerboard pattern is described; however, the arrangement is not limited thereto, and other thinned-out pattern in which the light emitting devices are arranged in other various patterns may be employed. For example, a line of the light emitting devices V in the direction perpendicular to the sheet conveying direction or a line of the light emitting devices V in the sheet conveying direction may thinned out every two lines.

A droplet drying device 14*a* according to a second exemplary embodiment will be described with reference to FIGS. 4A to 4C. In the exemplary embodiment, the light emitting devices V having low light output capability are arranged in the low irradiation capability portion.

Figure 4A:
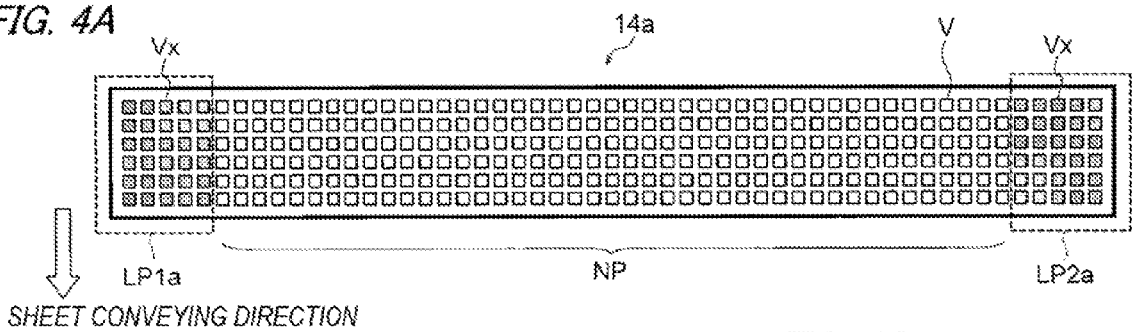
FIG. 4A is a diagram illustrating an arrangement of light emitting devices in a light emitting device array of a droplet drying device according to a second exemplary embodiment of the present invention.
Figure 4B:
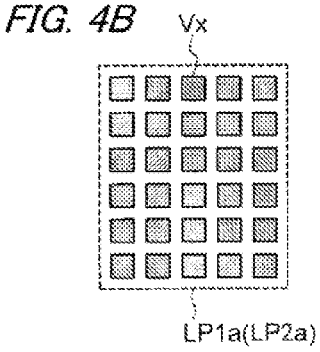
FIG. 4B is a diagram illustrating an arrangement of light emitting devices in a low irradiation capability portion of the droplet drying device according to the second exemplary embodiment.

As shown in FIG. 4A, the droplet drying device 14*a* according to the exemplary embodiment includes the regular irradiation capability portion NP, a low irradiation capability portion LP1*a*, and a low irradiation capability portion LP2*a*. Then, as shown in FIG. 4B, instead of the light emitting devices V exhibiting common light output characteristics, light emitting devices Vx having low light output capability are arranged in the low irradiation capability portions LP1*a* and LP2*a*. The low irradiation capability portions LP1*a* and LP2*a* configured as described above have reduced irradiation capability (drying capability), compared to the regular irradiation capability portion NP.

Here, in the exemplary embodiment, the light emitting device Vx has the same structure as the light emitting device V, and is manufactured using a wafer having the same layout pattern. Then, in a test process of light output in a wafer stage, the light emitting devices are classified into ranks (grades) by the measured light emission intensity with the same drive current, then, for example, a light emitting device in the rank of common light output (designed light output) is used as the light emitting device V, and a light emitting device in the rank of low light emitting output is used as the light emitting device Vx.

Figure 4C:
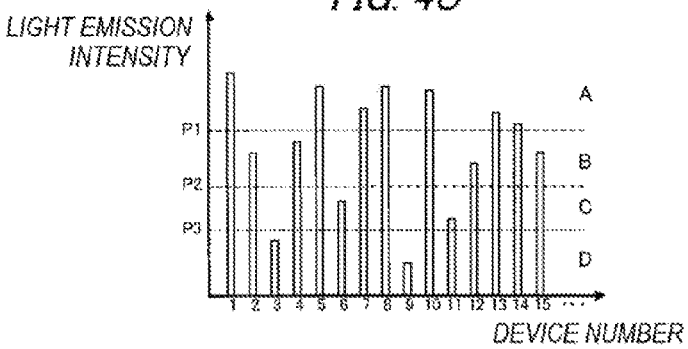
FIG. 4C is a diagram illustrating an example of test results of the light emitting devices.

An example of results of the light output test process is shown in FIG. 4C. FIG. 4C is a graph in which light emission intensity of the light emitting devices in a wafer, which is measured with a predetermined drive current, is plotted, with the horizontal axis representing an element number of the light emitting device, and the vertical axis representing light emission intensity.

In the exemplary embodiment, as an example, the light emitting devices are classified into a rank A to a rank D in descending order of light emission intensity. In other words, a light emitting device having the light emission intensity of P1 or higher in FIG. 4C is classified to be in the rank A, a light emitting device having the light emission intensity of P2 or higher and lower than P1 is classified to be in the rank B, a light emitting device having the light emission intensity of P3 or higher and lower than P2 is classified to be in the rank C, and a light emitting device having the light emission intensity of lower than P3 is classified to be in the rank D. For example, the light emitting device with element number 1 is classified to be the rank A. In addition, in the exemplary embodiment, elements in the ranks A to C are non-defective products and elements in the rank D are defective products. The light emitting devices in the ranks A to C are used according to uses, respectively, and the elements in the rank D are not used because it is considered that the elements are problematically manufactured.

In the exemplary embodiment, for example, the light emitting devices in the ranks A and B are the light emitting devices V that are arranged in the regular irradiation capability portion NP, and the light emitting devices in the rank C are the light emitting devices Vx that are arranged in the low irradiation capability portion LP. It is needless to say that a combination of the rank of the light emitting devices that are arranged in the regular irradiation capability portion NP and the rank of the light emitting device that are arranged in the low irradiation capability portion LP is not limited thereto, and, for example, the light emitting devices in the rank A may be the light emitting devices V that are arranged in the regular irradiation capability portion NP, and the light emitting devices in the ranks B and C may be the light emitting devices Vx that are arranged in the low irradiation capability portion LP.

As described above, since, in general, the price of the light emitting device having low light output capability is reduced to be lower than the price of the light emitting device having the regular light output capability, the costs of the droplet drying device according to the exemplary embodiment is reduced.

Note that, in the exemplary embodiment, the example, in which the light emitting devices are classified into ranks in the light output test process in the wafer stage, is described, the classification is not limited thereto. For example, in a case where light emitting devices are mounted in the droplet drying device in a state of being sealed in a package, an example, in which the light emitting devices are classified into ranks in a light output test process in a state of being sealed in the package.

Figure 5A:
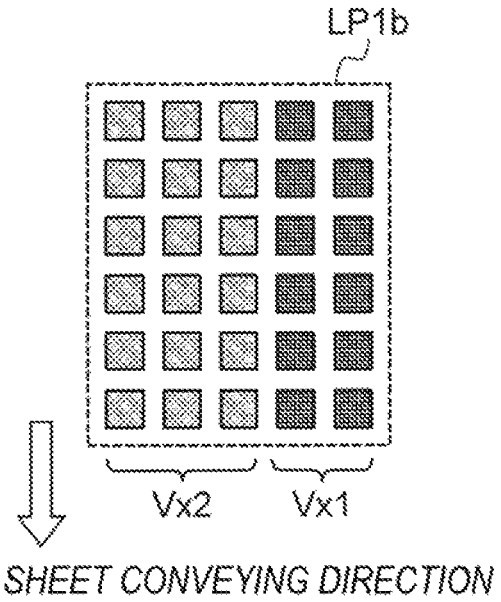
FIGS. 5A and 5B are diagrams illustrating an arrangement of light emitting devices in a low irradiation capability portion according to a modified example of the second exemplary embodiment.
Figure 5B:
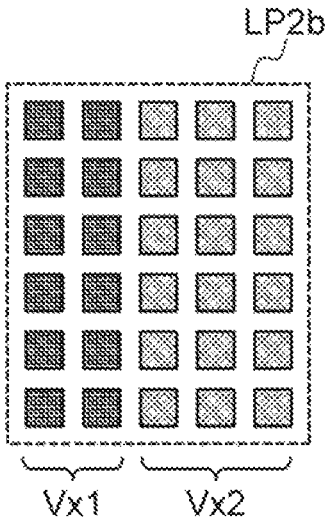

FIGS. 5A and 5B show the low irradiation capability portions LP1*b* and LP2*b* in a droplet drying device 14*b* (not shown) according to a modified example of the second exemplary embodiment. In the droplet drying device 14*b* according to the exemplary embodiment, the configuration of the regular irradiation capability portion NP is the same as that in FIG. 4A, and thus, the low irradiation capability portion LP1*a* shown in FIG. 4A is replaced with the low irradiation capability portion LP1*b* shown in FIG. 5A, and the low irradiation capability portion LP2*a* shown in FIG. 4A is replaced with the low irradiation capability portion LP2*b* shown in FIG. 5B. The low irradiation capability portions LP1*b* and LP2*b* according to the exemplary embodiment are formed in line symmetry such that the drying capability does not change in a direction orthogonal to the sheet conveying direction. Hence, since there is no difference between the low irradiation capability portions LP1*b* and LP2*b* except for being disposed in the line symmetry, hereinafter, the low irradiation capability portion LP1*b* is described as an example.

As shown in FIG. 5A, in the light emitting device array VA according to the exemplary embodiment, the low irradiation capability portion LP1*b* is configured to have lines (two lines in FIG. 5A) of light emitting devices Vx1 arranged in the sheet conveying direction and lines (three lines in FIG. 5A) of link emitting devices Vx2. Then, the light emitting devices in the rank B shown in FIG. 4C are used as the light emitting devices Vx1 and the light emitting devices in the rank C shown in FIG. 4C are used as the light emitting devices Vx2. Note that the light emitting devices in the rank A are used in the regular irradiation capability portion NP of the light emitting device array VA.

For example, the droplet drying device 14*b* according to the exemplary embodiment is configured to be useful in a case where the drying capability in the direction orthogonal to the sheet conveying direction needs to be changed in stages, or the like, depending on the drying target or the like.

Note that, in the exemplary embodiment, the example, in which the light emitting devices Vx1 and Vx2 are arranged from the inner side of the light emitting device array VA, is described; however, the arrangement is not limited thereto, and an example, in which the light emitting devices Vx2 and Vx1 are arranged from the inner side, may be employed. The number of lines is not limited to the combination of two lines and three lines. The number of lines may be appropriately selected, depending on the drying target or the like. In addition, in the exemplary embodiment, the light emitting devices Vx1 and Vx2 arranged in the sheet conveying direction are described as examples; however, the light emitting devices Vx1 and Vx2 may be arranged in the direction orthogonal to the sheet conveying direction, depending on the drying target or the like.

A droplet drying device 14*c* according to a third exemplary embodiment will be described with reference to FIGS. 6A to 6C in the exemplary embodiment, a part of the light emitting devices Vx are replaced with the light emitting devices V in the droplet drying device 14*a* according to the exemplary embodiment described above.

Figure 6A:
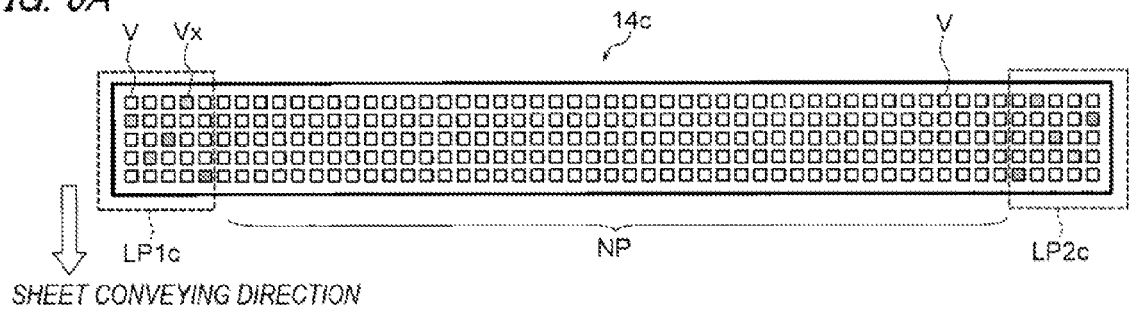
FIG. 6A is a diagram illustrating an arrangement of light emitting devices in a light emitting device array of a droplet drying device according to a third exemplary embodiment of the present invention.

As shown in FIG. 6A, the light emitting device array VA of the droplet drying device 14*c* according to the exemplary embodiment includes the regular irradiation capability portion NP, a low irradiation capability portion LP1*c*, and a low irradiation capability portion LP2*c*.

Figure 6B:
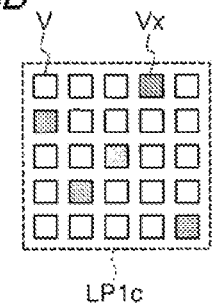
FIGS. 6B and 6C are diagrams illustrating an arrangement of light emitting devices in a low irradiation capability portion according to the third exemplary embodiment.
Figure 6C:
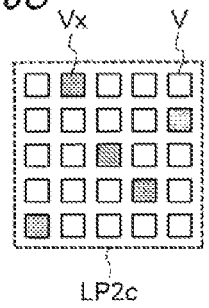

FIG. 6B shows the low irradiation capability portion LP1*c* according to the exemplary embodiment and FIG. 6C shows the low irradiation capability portion LP2*c*. In the exemplary embodiment, the low irradiation capability portions LP1*c* and LP2*c* are configured in line symmetry such that the drying capability in the direction orthogonal to the sheet conveying direction is uniform. Since there is no difference between the low irradiation capability portions LP1*c* and LP2*c* except for being disposed in the line symmetry, hereinafter, the low irradiation capability portion LP1*c* is described as an example.

As shown in FIG. 6B, the light emitting devices V having the regular light output capability and the light emitting devices Vx having the low light output capability are arranged, in a mixed manner, in the low irradiation capability portion LP1*c*. In the exemplary embodiment, a same number of light emitting devices Vx (one in the example in FIG. 6B) is arranged in each line in the sheet conveying direction. This is because the drying unevenness (irradiation unevenness) is significantly reduced in the low irradiation capability portion LP1*c*. However, the number of light emitting devices arranged in each line in the sheet conveying direction need to be equal to each other, and may be selected optionally depending on the drying target or the like.

In the droplet drying device according to the exemplary embodiment, the follow effects are achieved. Cost reduction is achieved and, the drying capability of the low irradiation capability portion is easily adjusted.

Figure 7:
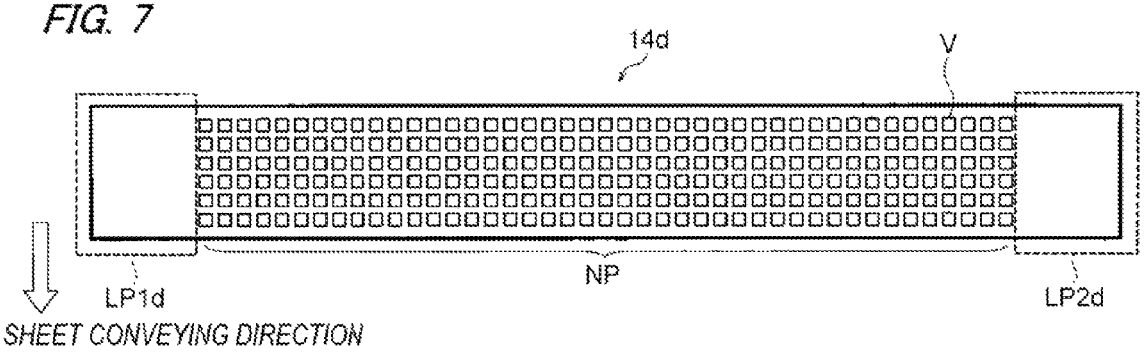
FIG. 7 is a diagram illustrating an arrangement of light emitting devices in a light emitting device array of a droplet drying device according to a fourth exemplary embodiment of the present invention.

Next, a droplet drying device 14*d* according to a fourth exemplary embodiment will be described with reference to FIG. 7. As shown in FIG. 7, the light emitting device array VA of the droplet drying device 14*d* includes the regular irradiation capability portion NP, a low irradiation capability portion LP1*d*, and a low irradiation capability portion LP2*d*.

As shown in FIG. 7, no light emitting devices are arranged in the low irradiation capability portions and LP2*d* according to the exemplary embodiment. The exemplary embodiment is applied to the image forming apparatus 10 when the no-image forming region GN has significantly low image forming density, for example, the no-image forming region GN is constantly a substantially margin. In a case where a mark M or the like having low image density needs to be dried, the image of the mark is dried with heat of irradiation light L that is generated by the light emitting devices V adjacent to the low irradiation capability portion LP in the regular irradiation capability portion NP and that radiates around.

Otherwise, the drying capability of the low irradiation capability portion LP according to the exemplary embodiment may be complemented in the following manner. That is, the light emitting devices having higher ranks shown in FIG. 4C (light emitting devices having ranks at which light outputs are higher than other light emitting devices) are arranged in the regular irradiation capability portion NP as the predetermined number of lines of the light emitting devices V which are adjacent to the low irradiation capability portion LP and which are arranged in the sheet conveying direction.

In the droplet drying device according to the exemplary embodiment, since there is no need to arrange the light emitting devices in the low irradiation capability portion, the costs are significantly reduced.

Note that, in the exemplary embodiments, the example, in which the low irradiation capability portions are disposed at both ends of the light emitting device array of the droplet drying device, is described; however, the disposition is not limited thereto, and an example, in which the low irradiation capability portion is disposed only one side, depending on the drying target, may be employed. Further, the low irradiation capability portion does not need to be disposed at the end portion of the light emitting device array, and may be disposed in any portion of the light emitting device array, as long as the low irradiation capability portion is disposed in a region corresponding a region in which the image forming density is constantly low. Otherwise three or more low irradiation capability portions may be provided, as necessary.

In addition, in the exemplary embodiments, the example, in which the irradiation capability of both of the two low irradiation capability portions (LP1 and LP2) is lowered with the same method, is described; however, the lowering is not limited thereto, and an example, in which the irradiation capability of both of the low irradiation capability portions is lowered by different methods, respectively, may be employed. In other words, in the droplet drying device 14 shown in FIG. 3A, an example, in which the low irradiation capability portion LP1 is maintained as in FIG. 3A, and the low irradiation capability portion LP2 is replaced with the low irradiation capability portion LP2*a* shown in FIG. 4B, may be employed. The droplet drying device, to which the example is applied, is suitable for a case where the image forming density of the no-image forming region GN is different between both sides of the continuous paper P in the sheet conveying direction, or the like.

In addition, in the exemplary embodiments described above, the example, in which the continuous paper is used as the recording medium, is described; however, the configuration is not limited thereto, and an example, in which a recording sheet cut to have a uniform size, that is, a so-called cut sheet, is used as the recording medium, may be employed.

In addition, in the exemplary embodiments described above, the example, in which the invention is applied to single-side printing, is described; however, the invention is not limited thereto, and the invention may be applied to duplex printing.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A droplet drying device comprising:

a plurality of light emitting devices arranged in a two-dimensional manner to irradiate droplets with light to dry the droplets, the droplets being ejected on a recording medium by an ejection unit;

a regular irradiation capability portion provided in a region corresponding to an image forming region of the recording medium where an image is formed, the regular irradiation capability portion having a predetermined light irradiation capability; and a low irradiation capability portion provided in a region corresponding to a region of the recording medium set to have a lower image-forming density than the image forming region, a light irradiation capability of the low irradiation capability portion being lower than the predetermined light irradiation capability;

the image forming region being a region in which an actual image of an original document is formed, and the lower image-forming density region being a region distinct from the image forming region and being a margin on both sides of the recording medium in a sheet conveying direction.

2. The droplet drying device according to claim 1, wherein the plurality of light emitting devices is arranged in the two-dimensional manner such that the light emitting devices are arranged in a plurality of lines of in a conveying direction in which the recording medium is conveyed and in a direction intersecting the conveying direction.

3. The droplet drying device according to claim 2, wherein the plurality of light emitting devices comprises a first set of light emitting devices arranged in the regular irradiation capability portion and a second set of light emitting devices arranged in the low irradiation capability portion, wherein the second set of light emitting devices is arranged in a pattern in which the first set of light emitting devices arranged in the regular irradiation capability portion are thinned out.

4. The droplet drying device according to claim 3, wherein the second set of light emitting devices is arranged in the low irradiation capability portion such that a same number of light emitting device is arranged in each line in the conveying direction.

5. The droplet drying device according to claim 4, wherein the second set of light emitting devices is arranged in the low irradiation capability portion in a checkerboard pattern.

6. The droplet drying device according to claim 2, wherein the plurality of light emitting devices comprises a first set of light emitting devices arranged in the regular irradiation capability portion and a second set of light emitting devices arranged in the low irradiation capability portion, wherein the second set of light emitting devices comprises at least one low-output light emitting device having a lower light output capability than the first set of light emitting devices.

7. The droplet drying device according to claim 6, wherein the second set of light emitting devices comprises a plurality of low-output light emitting devices, each of the low-output light emitting devices having a lower light output capability than the first set of light emitting devices, wherein the plurality of the low-output light emitting devices is arranged in a pattern in which the first set of light emitting devices arranged in the regular irradiation capability portion are thinned out.

8. The droplet drying device according to claim 7, wherein numbers of the plurality of the low-output light emitting devices is arranged are arranged such that a same number of light emitting device is arranged in each line in the conveying direction.

9. The droplet drying device according to claim 7, wherein the plurality of low-output light emitting devices arranged in the low irradiation capability portion comprises a plurality of groups of light emitting devices, the groups being different from each other in light output capability.

10. The droplet drying device according to claim 2, wherein the plurality of light emitting devices is not arranged in the low irradiation capability portion.

11. The droplet drying device according to claim 1, wherein the region of the recording medium set to have the lower image-forming density than the image forming region is a region having a predetermined length on the recording medium from at least one end of the recording medium in the conveying direction of the recording medium.

12. An image forming apparatus comprising:

an ejection unit that ejects droplets on a recording medium to form an image on the recording medium; and a droplet drying device disposed downstream of the ejection unit in a conveying direction in which the recording medium is conveyed, wherein the droplet drying device comprises:

a plurality of light emitting devices arranged in a two-dimensional manner to irradiate the droplets with light to dry the droplets;

a regular irradiation capability portion provided in a region corresponding to an image forming region of the recording medium where the image is formed, the regular irradiation capability portion having a predetermined light irradiation capability; and a low irradiation capability portion provided in a region corresponding to a region of the recording medium set to have a lower image-forming density than the image forming region, a light irradiation capability of the low irradiation capability portion being lower than the predetermined light irradiation capability, the image forming region being a region in which an actual image of an original document is formed, and the lower image-forming density region being a region distinct from the image forming region and being a margin on both sides of the recording medium in a sheet conveying direction.

13. The image forming apparatus according to claim 12, wherein the recording medium is a paper roll.

* * * * *